United States Patent [19]

Felix-Dalichow

[11] 4,442,600

[45] Apr. 17, 1984

[54] JACK-KNIFE

[76] Inventor: Ernst-Wilhelm Felix-Dalichow, Brauereistrasse 14, D-5650 Solingen, Fed. Rep. of Germany

[21] Appl. No.: 308,493

[22] Filed: Oct. 5, 1981

[30] Foreign Application Priority Data

Oct. 4, 1980 [DE] Fed. Rep. of Germany ..... 3037588

[51] Int. Cl.[3] ..... B26B 1/02

[52] U.S. Cl. ..... 30/161

[58] Field of Search ..... 30/161, 160, 158

[56] References Cited

U.S. PATENT DOCUMENTS

| | | | |
|---|---|---|---|
| 2,728,139 | 12/1955 | Erickson | 30/161 X |
| 2,824,368 | 2/1958 | Bassett | 30/161 |
| 3,641,667 | 2/1972 | Leopoldi | 30/161 |
| 4,040,181 | 8/1977 | Johnson | 30/161 |
| 4,268,960 | 5/1981 | Reinschreiber | 30/161 |
| 4,354,313 | 10/1982 | Naifeh | 30/161 |

*Primary Examiner*—Jimmy C. Peters

*Attorney, Agent, or Firm*—Kerkam, Stowell, Kondracki & Clarke

[57] ABSTRACT

A jack-knife is disclosed having a holder and a blade hinged to said holder thus that it can be turned between a closed position in which its cutting edge is in a longitudinal slot of said holder and an opened position which is 180° offset to the closed position and in which the blade can be fixed. The holder of the jack-knife comprises of two joint parts which are injection molded. One of these parts has an integral spring means which acts against a tiltable latch lever. Said lever is pivotable inserted at the back of said holder into the longitudinal slot thereof thus that its latch portion engages a notch in the back of said blade to fix the blade when it is in its opened position. This jack-knife is accordingly composed only of four main parts and can therefore be produced very economically.

7 Claims, 4 Drawing Figures

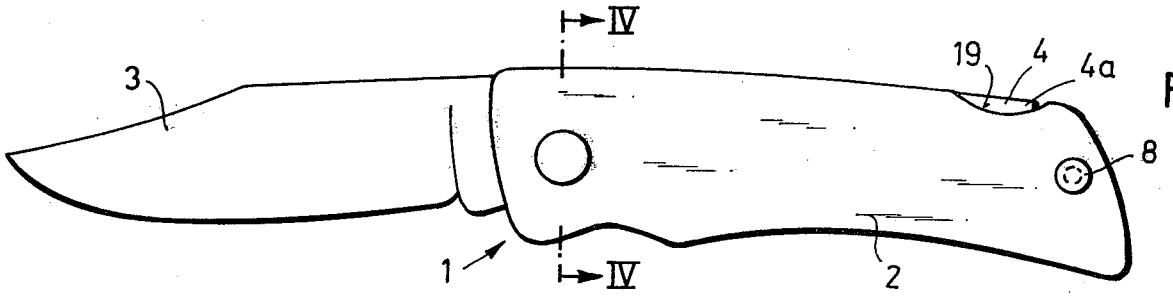
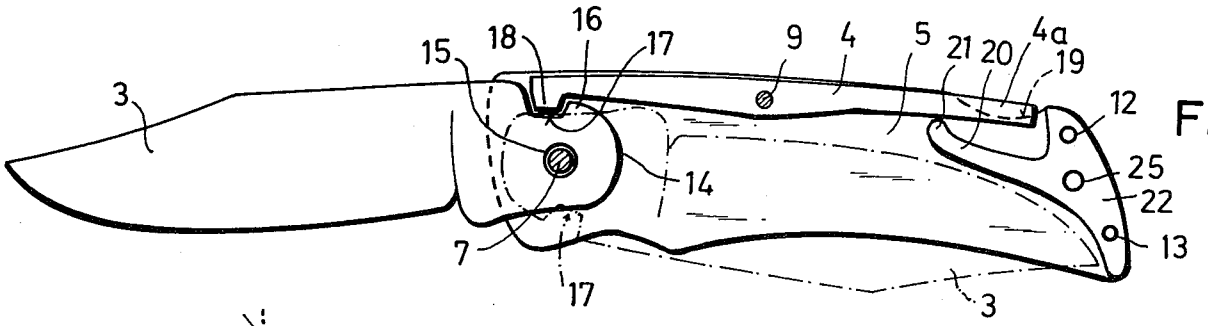
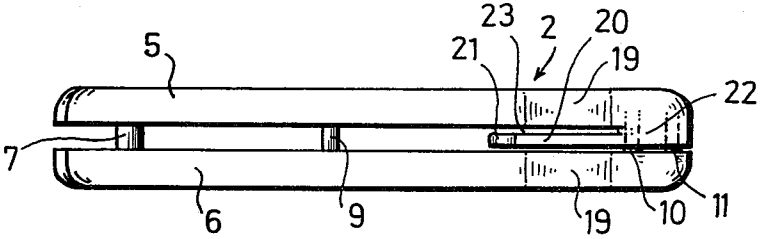
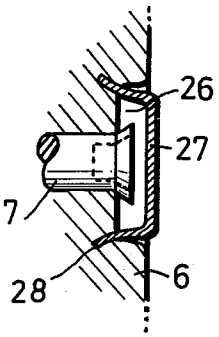
FIG. 4

JACK-KNIFE

The invention relates to a jack-knife having a holder and a blade hinged to said holder thus that it can be turned between the closed position in which its cutting edge is in a longitudinal slot of said holder and an opened position which is 180° offset to the closed position and in which the blade can be fixed by means of a latch lever which is tiltably supported at the back of said holder and which is biased by a spring means into its stop position.

Jack-knives of this kind are for instance larger pocket knives which are used by hunters, for camping and other leisure purposes. The production cost of these known jack-knives are relatively high since the holder thereof is composed of a plurality of parts which necessitate many working steps during production and assembly and also a lot of manual work. Therefore, modern production techniques suitable for a mass production by using automatic machines can be applied only in a limited degree.

It is an object of the invention to provide a jack-knife having a blade which can be fixed in its open position which knife is composed only of a limited number of parts and which can be produced mainly be machines without manual work, so that it can be produced by economic modern mass fabrication techniques.

Therefore, the present invention provides a jack-knife having a holder and a blade hinged to said holder thus that it can be turned between a closed position and an opened position, the holder being composed of only two joint parts moulded in plastics one of which parts having an integral spring means which acts against a tiltable latch lever which is pivotable inserted at the back of said holder into the longitudinal slot within said holder thus that its latch portion engages a notch in the back of said blade to fix the blade when it is in its opened position. The spring means is preferably an elongated member like a tongue extending into said longitudinal slot of said holder, which tongue is fixed with its rear end to a distance web integrally moulded with the one holder part at the rear end of said holder thus that it is movable relative to the opposing side walls of said longitudinal slot. Accordingly, the spring-like tongue is connected to one of the two holder parts only with its rear end while it does not have any further connection to the holder parts but can be moved within the longitudinal slot by means of the natural elasticity of the plastics or resin from which the tongue and the holder parts are moulded.

In paractice such spring means is obtained for instance thus that a thin plate of a thickness of for instance 0,3 mm is inserted into the injection moulding die for producing the respective holder part, which plate serves as core separating the tongue portion from the side wall of the longitudinal slot which is provided at said holder part. Accordingly, the tongue is integrally connected with said holder part only through the distance web having a height or thickness corresponding to the width of the longitudinal slot within the holder between the two holder parts when they are assembled.

In known jack-knives the spring means comprises for instance of a metal wire piece which is inserted into a distance web, which web is a separate part, so that two additional parts are required which cause additional costs during production and assembly. In accordance with the present invention the holder inclusive the spring co-acting with the latch lever comprises only of two parts which can be injection moulded and which can be simply and quickly assembled without the need of special assembly devices. A finishing of the surface of the assembled holder is not necessary.

Preferably, a cam portion is provided at the forward or outer end of the tongue which rests against the latch lever so that relative movement between tongue and the latch lever are easily possible if the latch lever is tilted.

In accordance with a further feature of the invention the latch lever is tiltably supported on an axis which extends across said longitudinal slot and snuggly fits with its ends into both parts of said holder. In other words, the latch lever is supported on an axis which also interconnects both holder parts and which assists in holding both holder parts together. Therefore, assembly of the latch lever is extremely simple since it is only necessary first to insert the axis into said holder part which comprises the spring-like tongue, thereafter the latch lever is fitted onto the axis. Then, the blade is laid onto this holder part, thereafter the other holder part is put up under slight pressure so that the inter engaging parts fit with one another. Now, the holder is completely assembled.

To facilitate assembly both holder parts are preferably connected to one another by inter engaging connecting means so that both holder parts have in addition to the axis snuggly inter engaging portions which guarantee an exact assembly. In order to secure the assembled holder parts together, preferably rivets are provided.

To this end, the pivot supporting the tiltable blade can be a headed hollow-type rivet, both ends of which are each covered by a cap driven with its rim into a recess in the outer surface of the respective holder part. Such caps are practically not releasable connected with the respective holder part so that the holder is a non-releasable unit after the caps have been attached.

Both holder parts can in addition at their rear end be connected to one another by means of a hollow-type rivet which is not only provided to obtain a non-releasable connection but can also be used for inserting a band or other holder element.

The invention provides a jack-knife with a blade which can be fixed in its open position, which is composed of substantially less parts than known jack-knives. Especially, the holder comprises only of two parts which can be injection moulded in plastics, between which parts only the blade and the latch lever cooperating with said blade are to be inserted during assembly. Therefore, jack-knives of this kind can be produced with substantially lower costs than comparable known jack-knives. Cost reductions up to 70% are possible which is of extreme importance for modern mass production.

In the drawings one embodiment of the jack-knife of the present invention is shown.

FIG. 1 is a side levation of the jack-knife with the blade in its opened position, FIG. 2 is a side elevation of the jack-knife similar like in FIG. 1, wherein, however, the forward part of the two holder parts is omitted to show details of the inner portions of the holder, FIG. 3 is a plan view of the two holder parts which are only partly assembled, wherein the blade and the latch lever are omitted, and FIG. 4 is a partial section along line IV—IV of FIG. 1 in an enlarged scale.

The jack-knife 1 shown in the drawings has a holder 2 and a blade 3 which can be turned between an opened and a closed position. Within the holder 2 a latch lever 4 is arranged which is limited tiltable and cooperates with blade 3 to hold it in its closed position within the holder 2 under friction while it locks the blade 3 when it has been turned out of the holder onto its opened position.

Holder 2 comprises substantially of two one-piece parts 5 and 6 injection moulded in plastics, which holder parts are interconnected by means of rivets 7 and 8, an axis 9 and pins 10 and 11 integral with holder part 6 which fit into holes 12 and 13, respectively, provided in holder part 5.

Blade 3 is supported on rivet 7 thus that it can be tilted to be turned out into the open position or inwards in a closed position which are both shown in FIG. 2.

Rivet 7 is a headed hollow-type rivet. The inner end 14 of blade 3 is curved and contains a hole 15 into which rivet 7 fits. Furthermore, blade 3 is at its inner end 14 provided with an inwardly curved flank portion 16 and on the opposite side with a notch 17. With this flank portion 16 and notch 17 a latch portion 18 cooperates which is provided at the inner side on the forward end of latch lever 4 so that latch portion 18 engages notch 17 when blade 3 is turned into its opened position so that it locks blade 3 in this position. If, however, blade 3 has been turned into its closed position in which its cutting edge lies within a longitudinal slot provided between both holder parts 5 and 6, latch portion 18 contacts flank portion 16 to frictionally hold blade 3 in its closed position to avoid any undesired movements of blade 3 which is easily tiltable on rivet 7.

Latch lever 4 is pivotable arranged on axis 9 which fits with its both ends into holder parts 5 and 6, respectively. The rear end 4*a* of latch lever 4 extends into a recess 19 at the back of both holder parts 5 and 6 while the other parts of latch lever 4 ly within holder 2, so that latch lever 4 can be tilted by pressing onto its rear end 4*a* with a finger in order that latch portion 18 is released from notch 17 if it is desired to turn blade 3 from its opened position in its closed position into holder 2.

Latch lever 4 is pressed into its position shown in FIG. 2 by means of a spring-like tongue 20 which is contacting the lower side of latch lever 4. Tongue 20 has at its forward or free end an upstanding cam 21, which is contacting latch lever 4.

Tongue 20 is integrally moulded with a distance web 22 which is integrally moulded with the rear end of holder part 5 so that tongue 20 is integral with holder part 5 and is injection moulded together with this holder part. The only connection between tongue 20 and holder part 5 is by means of distance web 22 so that between tongue 20 and the inner side of the main body of holder part 5 is provided a small space or slot 23. Therefore, tongue 20 can be flexibly moved relative to the inner wall of the main body of holder part 5 due to the elastic properties of the plastics or resin from which tongue 20, distance web 22 and holder part 5 are injection moulded. Accordingly, if the rear end 4*a* of latch lever 4 extending between the recesses 19 is pressed into holder 2, the forward or free end of tongue 20 is moved deeper into the longitudinal slot between holder parts 5 and 6 in order to tilt latch lever 4 around axis 9 so that latch portion 18 is removed from notch 17. In similar manner, the free end of tongue 20 is moved inwardly if blade 3 is turned from its closed position into its open position since the curved inner end 14 of blade 3 which has a larger distance from the center of hole 15 than the flank portion 16 has to pass underneath latch portion 18 of latch lever 4. The elasticity of spring-like tongue 20 is sufficient to bias latch lever 4 always in that position in which latch portion 18 either contacts the inwardly curved flank portion 16 or is inserted into notch 17.

The relative movements between tongue 20 and latch lever 4 when the latter is tilted are facilitated by a cam 21 which is provided at the free end of tongue 20 and contacts the inner side of latch lever 4 in every position thereof.

Rivet 8 is a hollow-type rivet and is inserted into a hole 25 provided at the rear end of both holder parts 5 and 6. FIG. 2 shows that hole 25 is provided within distance web 22 of holder part 5. The height or thickness of distance web 22 is slightly larger than the thickness of blade 3 while tongue 20 has a thickness which is slightly smaller than the maximum thickness of blade 3.

The outer ends of the headed hollow-type rivet 7 are lying in a sircular recess 26 which is provided at the outer surfaces of each of the holder parts 5 and 6. Each recess 26 is closed by means of a hollow cap 27, the circumferential outer rim 28 of which is driven into the material of the respective holder part 5 and 6, respectively, thus that this rim 28 is slightly bent outwardly as shown in FIG. 4. Therefore, caps 27 are practically non-releasably connected with holder parts 5 and 6, respectively, so that rivet 7 is completely covered and cannot be released to disassemble holder 2.

Since the above described jack-knife 1 comprises only relatively few parts, i.e. practically only four main parts (blade 3, latch lever 4 and the two holder parts 5 and 6), it can be economically produced and assembled. After assembly a finishing of the surfaces of jack-knife 1 is not necessary. For the assembly no special tools or devices are necessary since all parts can easily be assembled and since for the final assembly only pressure tools are necessary which fasten the rivets 7 and 8 and anchor caps 27 in their final position. For the assembly no special skill is necessary since all parts are thus designed that they exactly fit when assembled. Therefore, production costs of such jack-knives can be reduced up to 70% if compared with hitherto known jack-knives without reducing the quality of the new jack-knife.

What I claim is:

1. Jack-knife, having a holder and a blade hinged to said holder thus that it can be turned between a closed position in which its cutting edge is in a longitudinal slot of said holder and an opened position which is 180° offset to the closed position and in which the blade can be fixed, the holder being composed of two plastics molded joint parts, one of which having an integral spring means which acts against a tiltable latch lever which is pivotable inserted at the back of said holder into said longitudinal slot thus that its latch portion engages a notch in the back of said blade to fix the blade when it is in its opened position.

2. Jack-knife as claimed in claim 1, said spring means being a tongue extending into said longitudinal slot of said holder, which tongue is fixed with its rear end to a distance web integrally molded with the one holder part at the rear end of said holder thus that it is movable relative to the opposing side walls of said longitudinal slot.

3. Jack-knife as claimed in claim 2, said tongue being provided at its forward end with a cam-portion onto which said latch lever rests.

4. Jack-knife as claimed in anyone of the preceeding claims, the latch lever being tiltably supported on an axis which extends across said longitudinal slot and snuggly fits with its ends into both parts of said holder.

5. Jack-knife as claimed in claim 1, both parts of said holder having snuggly fitting interengaging portions and being secured to one another by riveting.

6. Jack-knife as claimed in claim 5, the pivot supporting the tiltable blade being a headed hollow-type rivet, both ends of which are each covered by a cap driven with its rim into a recess in the outer surface of the respective part of said holder.

7. Jack-knife as claimed in claim 5, both parts of said holder being secured to one another at their rear end by means of a hollow-type rivet.

* * * * *